US005971411A

United States Patent [19]

Jones et al.

[11] Patent Number: 5,971,411

[45] Date of Patent: Oct. 26, 1999

[54] SKATEBOARD TRUCK

[76] Inventors: John P. Jones, 4792 Indio Ave., Yucca Valley, Calif. 92284; John R. Jones, 1519 Halter, San Marcos, Calif. 92069

[21] Appl. No.: 08/991,691

[22] Filed: Dec. 16, 1997

[51] Int. Cl.[6] ..... B62M 1/00

[52] U.S. Cl. ..... 280/87.042; 280/11.28

[58] Field of Search ..... 280/11.27, 11.28, 280/87.042, 11.19

[56] References Cited

U.S. PATENT DOCUMENTS

| | | | |
|---|---|---|---|
| 1,550,985 | 8/1925 | Schluesselburg | 280/11.28 |
| 4,103,917 | 8/1978 | Widolf | 280/11.28 |
| 4,159,830 | 7/1979 | Solimine | 280/11.28 |
| 4,166,629 | 9/1979 | List | 280/11.28 |
| 4,645,223 | 2/1987 | Grossman | 280/11.28 |

*Primary Examiner*—Lanna Mai
*Assistant Examiner*—David R. Dunn

[57] ABSTRACT

An extruded skateboard truck base (11), which has an angled aperture for a cushion (13) on which a hanger (12) rests. A pivot bolt (14) holds hanger (12) to base (11) which allows weight placed on either side of the skateboard (22) to put pressure on cushion (13) thereby shortening the wheelbase on one side and lengthening it on the other, facilitating the turn. A slotted hole (20) in base (11) allows hanger (12) to move up and down on cushion (13) for a smoother ride. The straight down pressure exerted on cushion (13) eliminates the need for any adjusting mechanism.

1 Claim, 3 Drawing Sheets

SKATEBOARD TRUCK

BACKGROUND

1. Field of Invention

This invention relates to an improved truck for a skateboard or similar item and in particular one which is simpler and lighter in construction.

2. Description of Prior Art

A skateboard truck is that portion of the skateboard which carries the wheels and which is mounted onto the board itself. A rider applies his weight to the truck and the hanger of the truck pivots on the base, allowing the rider to turn right or left.

In prior art, a skateboard truck hanger is mounted on the base by means of a pin which is seated in a hole in the base and by a bolt which passes through a ring in the hanger and which is threaded into another hole in the base.

When the hanger pivots, forces are applied to the pin and to the hole in the base in which it is received which are lateral with respect to the axis of the pin. These forces cause twisting, binding and wearing of the pin, the hole in the base in which it is received and a bushing which is placed in the hole.

In prior art an axle goes through the hanger by means of a hole in the hanger casting. The axle is pressed into the hole. This process allows slippage of the axle.

In prior art the truck's base and hanger are made by sand casting or die casting aluminum.

Another significant factor in skateboard trucks is the weight of the truck itself.

In prior art the truck base is bolted to the skateboard by means of a bolt and nut that is not captivated.

OBJECTS AND ADVANTAGES

One objective of our skateboard truck is to eliminate the twisting, binding and wearing of the pin, the bolt and the bushings by mounting the hanger on an angle to the skateboard so the hanger does not have to twist to turn.

Another objective of our truck is to eliminate axle slippage by drilling and tapping the hanger.

Our skateboard truck base is so designed that the base and hanger of the skateboard truck can be extruded, which is lighter, stronger and more cost effective than the prior art's casting process.

By using the extrusion process for the base and hanger of the skateboard truck this allows the truck base to be bolted to the skateboard by means of a slot to captivate a nut. Thereby eliminating the need for a wrench.

Further features and advantages will become apparent by reference to the following drawings and detail description.

DRAWING FIGURES

RERERENCE NUMERALS IN DRAWINGS

| | |
|---|---|
| 11 base | 17 slot for mounting bolt nut |
| 12 hanger | 18 friction buffer |
| 13 cushion | 19 axle studs |
| 14 pivot bolt | 20 slotted hole |
| 15 cushion fastener screw | 21 wheel |
| 16 pivot bolt nut | 22 skateboard |
| 23 mounting bolt holes | |
| 24 mounting bolt | |
| 25 mounting bolt nut | |

SUMMARY

In accordance with the present invention a skateboard truck comprises a base having a resilient cushion on which rests a hanger in which an axle stud is received.

DETAILED DESCRIPTION OF THE PREFERRED EMBODIMENT

Figure 1:
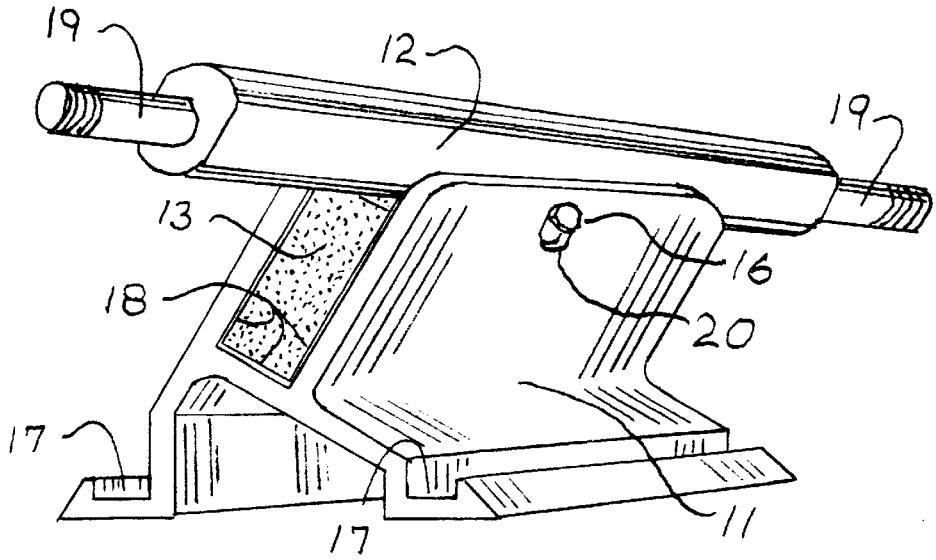
FIG. 1 is a view of a skateboard truck as seen from either end of the skateboard
Figure 2:
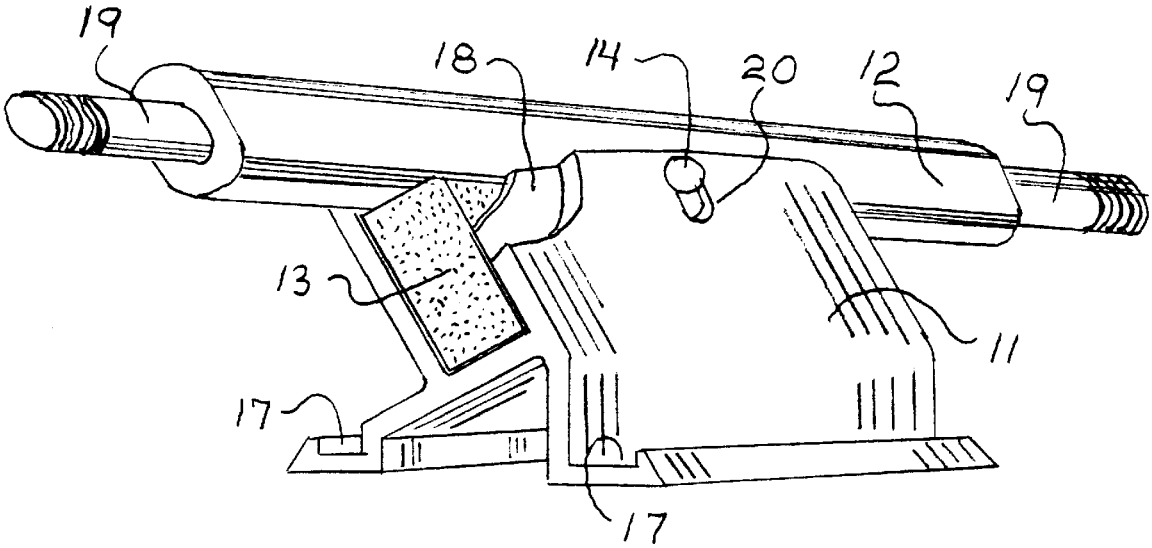
FIG. 2 is a view of a skateboard truck as seen from the center of the skateboard.

A typical embodiment of the skateboard truck of the present invention is illustrated in FIGS. 1 and 2. These figures show a perspective view of a truck. A flexible plastic friction buffer 18 encases a neoprene cushion 13 on three sides which is then placed in the aperture of an extruded aluminum base 11. In the preferred embodiment the friction buffer material is polytetrafluoroethyelene plastic. The cushion material can be neoprene or polyurethane or other such resilient materials. The base is made of 6061 extruded aluminum. Other similar grades of aluminum can be utilized. An extruded aluminum hanger 12 is placed in the aperture atop cushion 13. The hanger is made of the same material as the base.

Also shown in FIGS. 1 and 2, a threaded stainless steel pivot bolt 14 passes through a slotted hole 20 and through hanger 12 and is fastened by a pivot bolt nut 16. This is a lock nut. A wheel 21 (not shown) slips on a threaded grade 5 steel axle stud 19.

Figure 3:
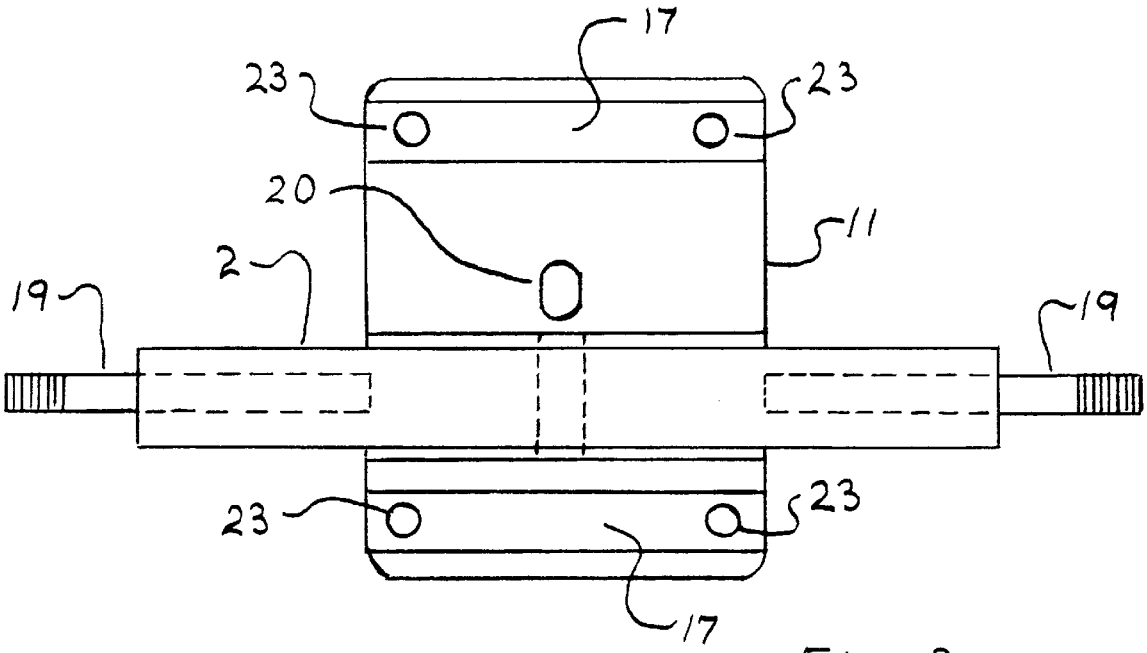
FIG. 3 is a top view of a skateboard truck.

FIG. 3 is a top view of a skateboard truck of the present invention. Axle studs 19 are inserted into hanger 12. The location of slotted hole 20 on base 11 is shown. The mounting bolt holes 23 location is shown in a slot for mounting bolt nuts 17.

Figure 4:
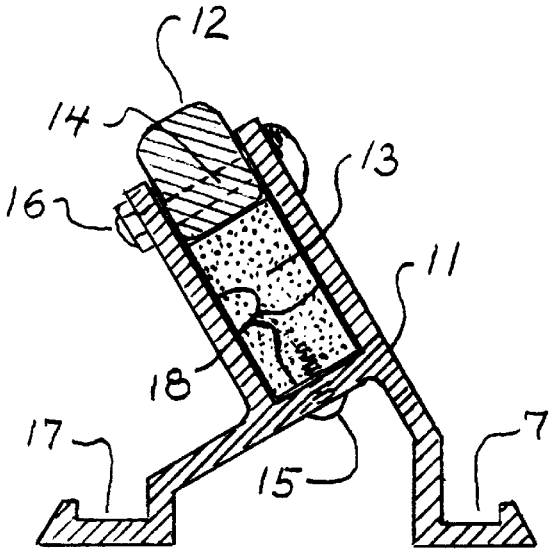
FIG. 4 is a cross section of the side elevation of a skateboard truck.

FIG. 4 is a cross section of the side elevation of a skateboard truck of the present invention. A cushion fastener screw 15 passes through base 11 and through friction buffer 18 into cushion 13. Pivot bolt 14 passes through base 11 and through hanger 12.

Figure 5:
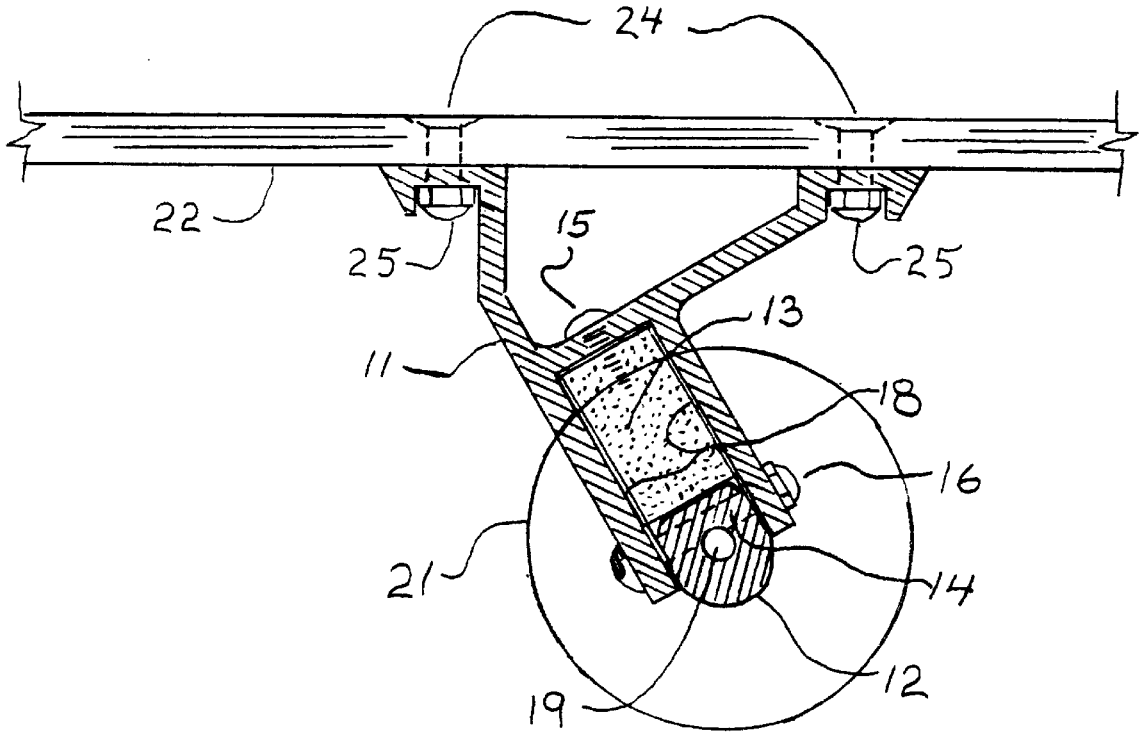
FIG. 5 is a side view of a skateboard truck mounted to a skateboard.

FIG. 5 is a side view of a skateboard truck of the present invention mounted to a skateboard. A mounting bolt 24 goes through skateboard 22 and base 11 and is secured by a mounting bolt nut 25. Axle stud 19 holds on wheel 21.

Operation of the Preferred Embodiment

In use, the parts are assembled as shown in FIGS. 1 and 2. By virtue of the angle on which base 11 is connected to skateboard 22 it allows hanger 12 to compress cushion 13 as weight is placed on either side of skateboard 22 thereby shortening the wheelbase on one side and lengthening it on the other, facilitating the turn.

Hanger 12 resting on cushion 13 allows the hanger to move in slotted hole 20 cushioning the ride by allowing the hanger to move up and down.

Conclusion, Ramification and Scope

Using an extruded method of construction for the base of the skateboard truck makes it stronger thereby allowing the truck to absorb more punishment from the rider.

Another important advantage of the extruded truck base is its lighter weight, which enhances the aerial maneuverability of the rider.

Due to the simplicity of the hanger construction it can be replaced without purchasing a whole new skateboard truck. The hanger can be replaced easily and inexpensively.

In the prior art the twisting motions of the hanger causes wear on the cushion making it necessary to tighten the kingbolt frequently.

With the present invention a straight down force is exerted upon the cushion eliminating the need for any adjusting mechanism.

The cushion can be changed to allow for the individual rider's preference for a firmer or softer ride.

In essence this skateboard truck looks quite different than those offered for sale in skateboard shops today. It is designed more simply to arrive at a product that is lighter and more rugged than those of prior art.

Although the description above contains many specificities these should not be construed as limiting the scope of the invention but as merely providing illustrations of some of the presently preferred embodiments of this invention.

Thus the scope of the invention should be determined by the appended claims and their legal equivalents, rather than by the examples given.

We claim:

1. A truck for a skateboard, comprising: an extruded base with mounting bolt holes along two parallel slots for mounting to a skateboard; said base includes an elongated, rectangular, angled aperture which encases a resilient cushion; an extruded hanger rests on said resilient cushion; said hanger includes drilled and tapped holes at each end to each receive an axle stud for mounting wheels; a slotted hole on both sides of the angled aperture of the base to allow the hanger to move up and down on the cushion; a pivot bolt attaches the hanger to the base through the slotted holes on the two opposite sides of the angled aperture of the base.

* * * * *